US005213227A

United States Patent [19]

Koyama et al.

[11] Patent Number: 5,213,227

[45] Date of Patent: May 25, 1993

[54] CONTAINER HAVING EXCELLENT PRESERVABILITY FOR CONTENT AND HEAT-SEALABILITY

[75] Inventors: Masayasu Koyama, Zushi; Toshifumi Tanahashi, Yokohama; Kanemichi Yamaguchi, Yokohama; Toshio Goryoda, Yokohama, all of Japan

[73] Assignee: Toyo Seikan Kaisha Ltd., Tokyo, Japan

[21] Appl. No.: 687,874

[22] PCT Filed: Jun. 4, 1991

[86] PCT No.: PCT/JP90/01287

§ 371 Date: Jun. 4, 1991

§ 102(e) Date: Jun. 4, 1991

[87] PCT Pub. No.: WO91/04913

PCT Pub. Date: Apr. 18, 1991

[30] Foreign Application Priority Data

Oct. 4, 1989 [JP] Japan ..... 1-116190[U]
Mar. 6, 1990 [JP] Japan ..... 2-52675

[51] Int. Cl.[5] ..... B65D 41/00

[52] U.S. Cl. ..... 220/359; 220/450; 220/456; 220/458; 229/3.5 MF; 383/113; 383/116; 426/126

[58] Field of Search ..... 220/359, 450, 454, 456, 220/458, 461; 229/3.5 MF; 428/457, 461, 34.3, 35.8, 35.9, 36.5; 383/113, 116; 426/126

[56] References Cited

U.S. PATENT DOCUMENTS

| | | | |
|---|---|---|---|
| 4,436,220 | 3/1984 | Simmons | 220/359 |
| 4,665,309 | 5/1987 | Derbshire | 220/359 X |
| 4,810,541 | 3/1989 | Newman et al. | 220/359 X |
| 4,915,289 | 4/1990 | Hatano et al. | 220/359 X |

OTHER PUBLICATIONS (A), 63-125151, May 1988, Japan.

*Primary Examiner*—Allan N. Shoap
*Assistant Examiner*—Nova Stucker
*Attorney, Agent, or Firm*—Sughrue, Mion, Zinn, Macpeak & Seas

[57] ABSTRACT

A container is made of a laminated material that includes a tin layer which is exposed on the inner surface side of the container. Oxygen remaining in the container and included in the content is trapped by the reducing action of tin, and the content is prevented from being oxidized. Further, the remaining enzymes are deactivated and flavor can be excellently retained.

12 Claims, 4 Drawing Sheets

CONTAINER HAVING EXCELLENT PRESERVABILITY FOR CONTENT AND HEAT-SEALABILITY

TECHNICAL FIELD

The present invention relates to a container having excellent preservability for content and heat-sealability. More specifically, the invention relates to a container having a tin layer exposed on the content-accommodating side of the container.

BACKGROUND ART

Conventional containers having hermetically sealing performance based upon heat sealing include a container with flange obtained by draw-molding a laminated material which consists of laminating a thermoplastic resin film on both surfaces of a metal foil or draw-molding a laminated material consisting of a lamination of a gas-barrier resin film and a thermoplastic resin, a cup with heat-sealable closure consisting of a flexible substrate obtained by laminating a thermoplastic resin film on both surfaces of a metal foil, and a retort pouch using a laminated material obtained by laminating a thermoplastic resin film on both surfaces of a metal foil or using a laminated material obtained by laminating a thermoplastic resin film on a gas-barrier resin film, and have been used for containing foods. After the contents are packed therein and sealed, the containers are usually heated for sterilization.

Despite the foods are packed in the containers and are hermetically sealed by heating followed by sterilization by heating, however, there remains a problem in that the foods are discolored or are oxidized to lose flavor due to oxygen in the air entrapped when the foods are packed, due to oxygen contained in the foods or due to active enzymes in the foods during the storage and, especially, as they are stored for extended periods of time no matter how excellent barrier properties the containers and closures exhibit.

DISCLOSURE OF THE INVENTION

The present invention is to solve the above-mentioned problem inherent in the conventional containers such as cups with closure and pouches that are hermetically sealed by heating, and its object is to provide a container that can be excellently sealed hermetically by heating and can be easily opened and that excellently preserves the content.

Another object of the present invention is to provide a container that enables the content such as food to be sterilized by heating and that by itself exhibits excellent gas-barrier property, oxygen shut-off property and sealing property upon heating, and that further works to prevent the content from being discolored or deteriorated by the residual oxygen or enzyme, making it possible to excellently preserve the content without losing flavor.

According to a first embodiment of the present invention, there is provided a container comprising a seamless container with flange which consists of a thermoplastic resin film and a tin-containing laminated material and which is so draw-molded that the resin film is on the outer surface side and the tin-containing laminated material is on the inner surface side and that the tin layer is exposed on the inner surface side, a flexible closure consisting of a laminated material of a gas-barrier substrate and protective resin layers covering the inner and outer surfaces thereof, and a sealed portion formed by heating via an acid-modified olefin resin layer that is interposed between the upper surface of the flange and the inner surface of the closure.

According to a second embodiment of the present invention, furthermore, there is provided a container in which the peripheral portions of the opposing laminated materials are sealed by heating and a portion for accommodating the content is formed between the opposing laminated materials, wherein at least either one of the opposing laminated materials is a tin-containing laminated material consisting of a thermoplastic resin outer surface protecting layer, a metal foil or a thin film of tin on the inner surface side of the container and a resin layer formed on the inner surface of the metal foil or thin film of tin, and the tin-containing laminated material has a resin layer that is porous and that permits tin to be partly exposed relative to the opposing laminated material.

According to the present invention in which the tin layer is exposed on the inner surface of the container body, oxygen remaining in the container is trapped, i.e., oxygen in the air remaining in the container or oxygen contained in the content such as food even after the container is closed, is trapped by the reducing action of tin. Therefore, the content is prevented from being oxidized or deteriorated, and the activity of enzymes present in the food is lowered, making it possible to preserve the content in excellent condition without losing flavor.

According to the first embodiment of the present invention, even in case the tin plate might be corroded by the components of food, elution of tin prevents the elution of iron enabling flavor to be favorably preserved. Furthermore, the above-mentioned reducing action of tin helps suppress the generation of hydrogen gas when iron is eluted as well as the accompanying expansion of the container. Moreover, even in case pitting takes place in the tin plate, the thermoplastic resin film that serves as an outer layer does not permit the content to leak.

According to this first embodiment, the container body is formed as a seamless container with flange using a laminated material obtained by laminating a resin film on a tin plate that has excellent property for blocking the permeation of gases and, particularly, oxygen. Therefore, the container exhibits excellent property for blocking the permeation of gases and oxygen. Furthermore, the closure consists of a laminated material, too, that is obtained by providing a protective resin layer on the inner and outer surfaces of the gas-barrier substrate and exhibits excellent property for blocking the permeation of gases and oxygen. Moreover, the sealed portion that is accomplished by heating via an acid-modified olefin resin layer of the flange of the container body offers reliable sealing. Thus, the container itself is hermetically sealed and exhibits excellent gas-barrier property and, particularly, excellent oxygen shut-off property.

According to the second embodiment of the present invention, a porous resin layer is provided on the tin layer, and this resin layer prevents iron from eluting even in case impact is given to the container and the tin layer is cracked. Furthermore, since the resin layer is porous, the same effects as those of the first embodiment are obtained through the pores owing to the reducing action of tin.

The heat-sealed portion of the container according to the second embodiment exhibits excellent and reliable sealing, since the resin layer on the surface of the tin-containing laminated material is a continuous covering layer or the covering resin layer forming a continuous layer despite the presence of pores which are located on the inside and having diameters narrower than the width of the heat-sealed portion, the pores not being communicated with one another but being independent ones.

When the container must satisfy the requirements of sealability and easy openability as represented by a cup with closure, the easy openability can, as required, be imparted by using a resin layer at the heat-sealed portion.

The container of the present invention can be subjected to the sterilization by heating (pressurized steam, boiling water, microwave oven, etc.) and can further be subjected to the high-frequency induced heating owing to the provision of the tin layer.

The container of the present invention having the aforementioned excellent effects can be favorably used for preventing the degeneration of contents such as foods and beverages yet maintaining flavor. The container can further be extensively used for other contents that are strongly desired to be preserved.

BRIEF DESCRIPTION OF THE DRAWINGS

FIGS. 9-1 and 9-2(*d*) and (*b*) are a section view of a portion for accommodating the content and section views of the heat-sealable portion;

BEST MODE FOR CARRYING OUT THE INVENTION

The constitution according to a first embodiment of the present invention will now be described in conjunction with the accompanying drawings.

Figure 1:
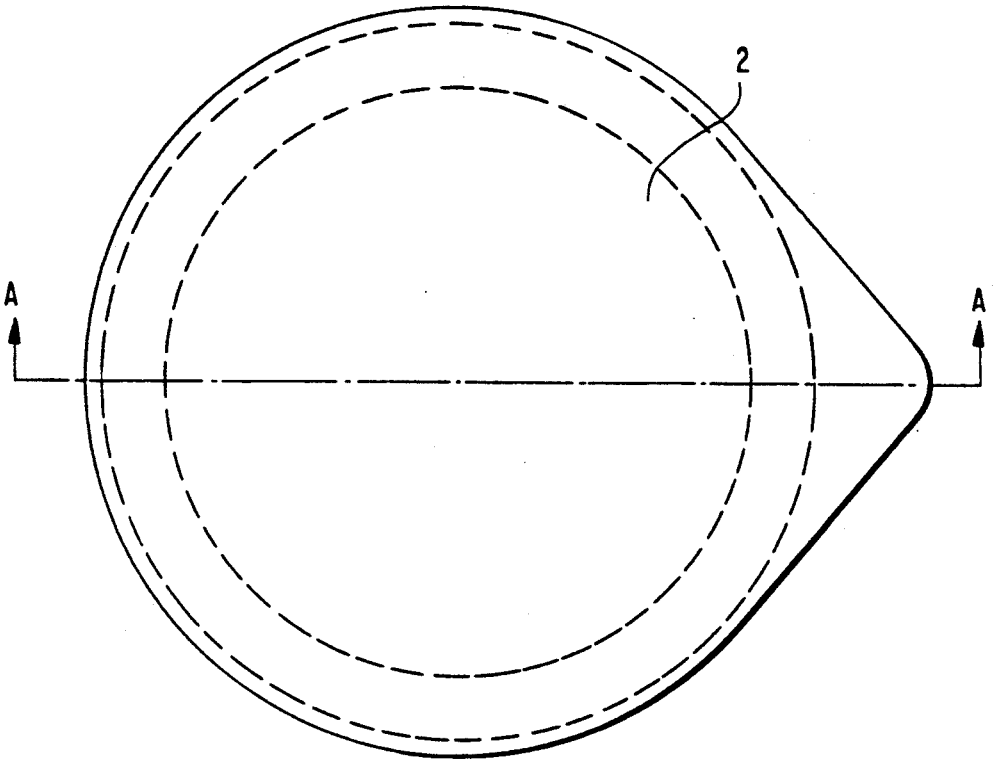
FIGS. 1 and 2 are a plan view and a vertical section view of a container according to a first embodiment of the present invention.
Figure 2:
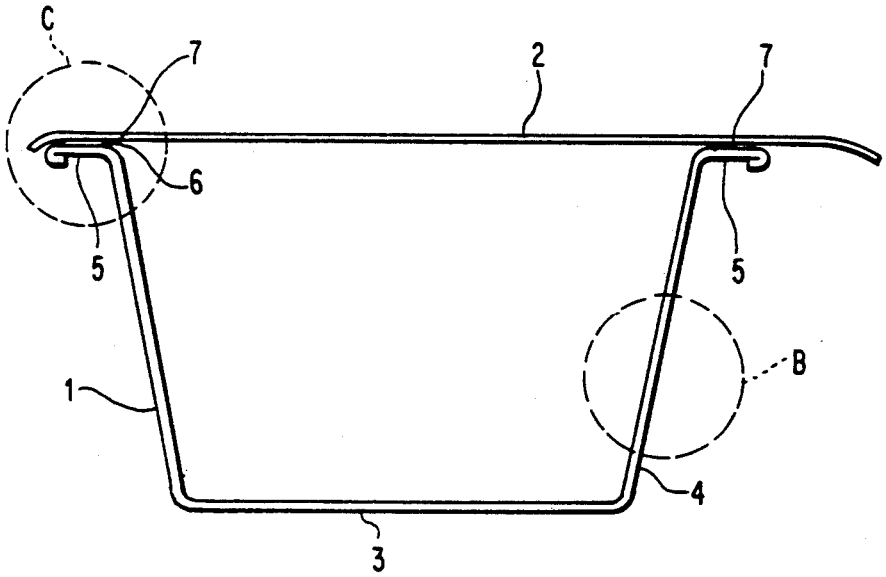

In FIGS. 1 and 2, reference numeral 1 denotes a seamless container with flange, i.e., a container body, and 2 denotes a closure. The container body 1 consists of a bottom portion 3, a side wall portion 4 and a flange portion 5, and is formed in a seamless manner. Reference numeral 6 denotes an acid-modified olefin resin layer which joins the upper surface of flange portion 5 of the container body to the inner surface of the closure 2 thereby to form a sealed portion 7.

Figure 3:
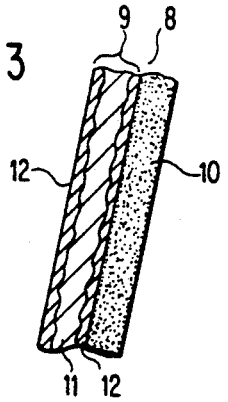
FIG. 3 is a diagram showing a portion B of FIG. 2 on an enlarged scale.

A laminated material 8 that constitutes the container body 1 consists, as shown in FIG. 3, of a tin plate 9 on the inner surface side of the container and a thermoplastic resin film 10 of the outer surface side. Further, the tin plate 9 has tin layers 12 on the surfaces of a steel layer 11, the tin layer 12 on one surface of the tin plate 9 being exposed on the inner surface side of the container and the tin layer 12 on the other surface being adhered to the thermoplastic resin film 10. Here, the tin plate 9 may have the tin layer 12 on one surface only of the steel layer 11. In this case, the container body 1 is formed by the laminated material 8 that has the tin layer 12 exposed on the inner surface of the container and the steel layer 11 that is directly adhered to the thermoplastic resin film 10.

Figure 4:
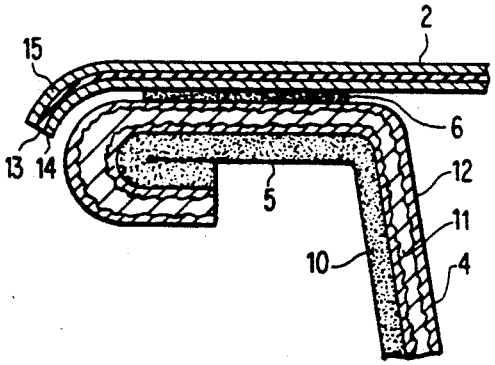
FIG. 4 is a diagram showing a portion C of FIG. 2 on an enlarged scale.

As shown in FIG. 4, the closure 2 consists of a laminated material of a gas-barrier substrate 13, and protective resin layers 14 and 15 applied to the inner and outer surface thereof, and is flexible.

The tin layer 12 of tin plate 9 on the upper surface of flange portion 5 of the container body 1 and the inner protective resin layer 14 of the closure 2 are bonded together by heating via the acid-modified olefin resin layer 6 thereby to form a sealed portion 7.

Next, the constitution according to the second embodiment of the present invention will be described.

Referring to FIGS. 5 to 8, reference numeral 21 denotes a seamless container with flange, i.e., a container body, and 22 denotes a closure. The container body 21 and closure 22 are both made of laminated materials. In particular, the container body 21 is made of a tin-containing laminated material. The container body 21 consists of a bottom portion 23, a side wall portion 24 and a flange portion 25, and is formed in a seamless manner. Reference numeral 26 denotes a heat-sealed portion where the upper surface of flange portion 25 of the container body is joined by heating to the inner surface of the closure 22 to form the container excellent in sealability.

Figure 7:
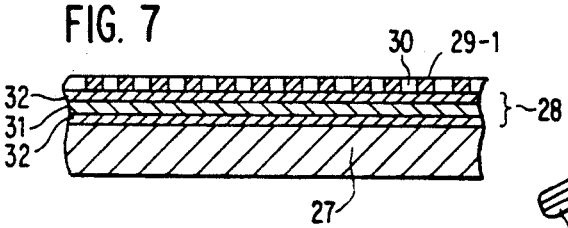
FIG. 7 is a diagram showing a portion E of FIG. 6 on an enlarged scale.

The laminated material constituting the container body 21 contains tin, and consists of a laminate of a thermoplastic resin 27 which is a thermoplastic resin outer surface protecting layer, a tin plate 28 on the inner surface thereof, and a resin layer 29 further on the inner surface thereof. In the content-accommodating portion, i.e., on the bottom portion 33 and on the side wall portion as shown in FIG. 7, the resin layer 29 consists of a porous resin layer 29-1 having many pores 30. In the heat-sealed portion, i.e., in the flange portion as shown in FIG. 8, the resin layer 29 consisting of a continuously covering resin layer or a resin layer which is a continuously covering resin layer 29-2 in which the pores may exist but on the inside having diameter narrower than the width of the heat-sealed portion as independent pores without communicated with each other.

The pores, if they exist, are located in the resin layer on the inside having diameters narrower than the width of the heat-sealed portion as independent pores without communicated with each other. Further, since the resin layer is covered with a continuous layer, hermetic sealability is obtained upon heating. The tin plate 28 has tin layers 32 on the surfaces of a steel layer 31, the tin layer 32 on the inner surface side of the tin plate 28 being adhered to the resin layer 29 (29-1 and 29-2) and being exposed on the bottom portion 23 and on the side wall portion 24 to the inner surface side of the container through numerous pores 30. The tin layer 32 on the other surface is adhered to the thermoplastic resin film 27. Here, the tin plate 28 may have the tin layer 32 on one surface only of the steel layer 31. In this case, the tin layer 32 is on the inner surface side of the container, and the steel layer 31 is directly bonded to the thermoplastic resin film 27.

Figure 8:
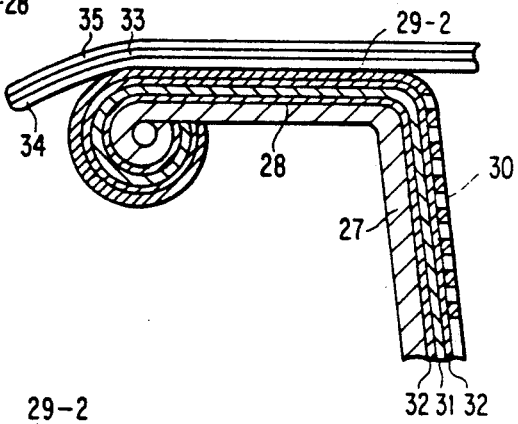
FIG. 8 is a diagram showing a portion F of FIG. 6 on an enlarged scale.

As shown in FIG. 8, the laminated material constituting the closure 22 consists of a laminate of a gas-barrier substrate 33 and protective resin layers 34 and 35 covering the inner and outer surfaces thereof, and is flexible. It is further allowable to use the laminated material constituting the container body 21 as the closure and to use the laminated material constituting the closure 22 as the container body.

The resin layer 29-2 on the tin plate 28 on the flange portion 25 of the container body 21 and the resin layer 34 on the inner surface of the closure 22 are joined together by heating, and whereby the heat-sealed portion 26 is formed and a container is obtained having excellent sealability.

Figures 1, 9:
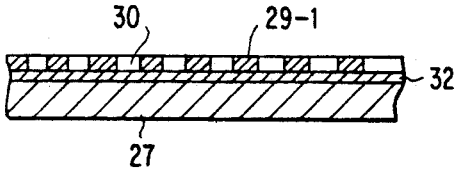
Figures 2A, 9:
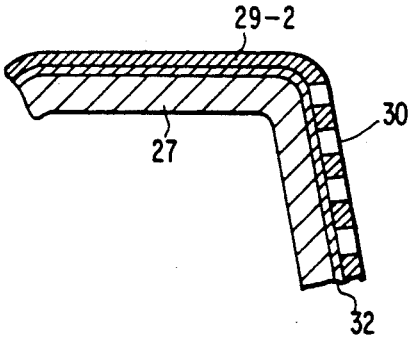
Figures 2B, 9:
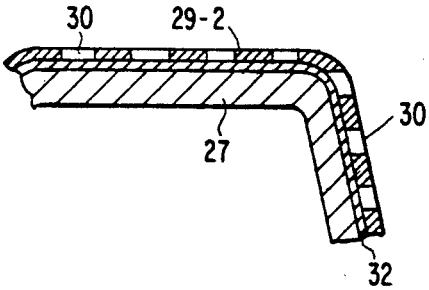
Figure 5:
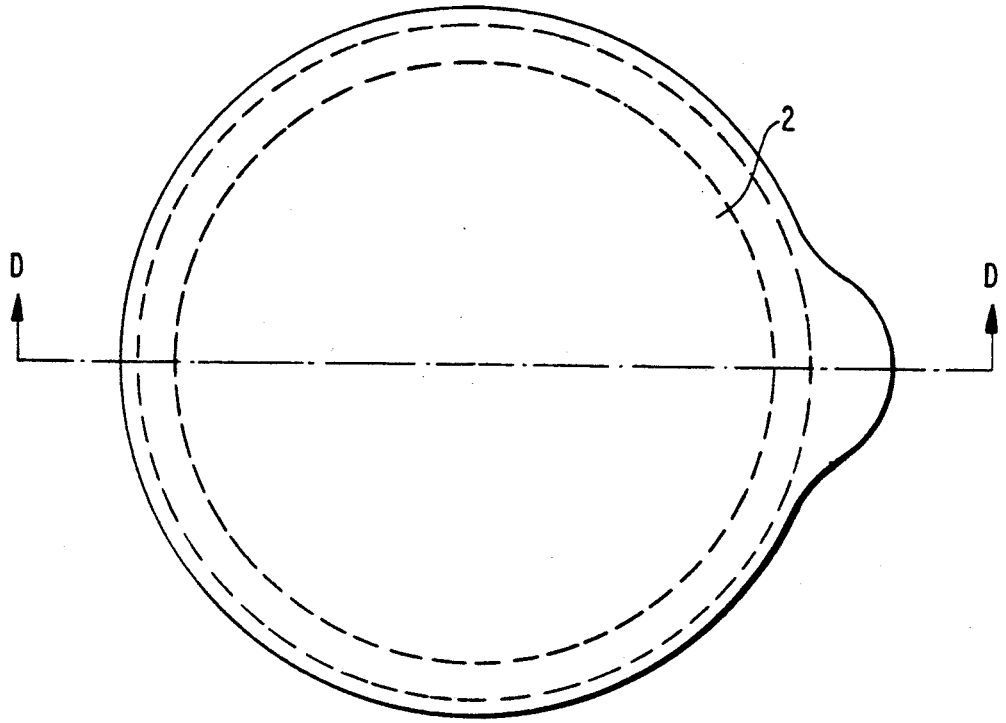
FIG. 5 is a plan view of a cup-like container with heat-sealable closure according to a second embodiment of the present invention.
Figure 6:
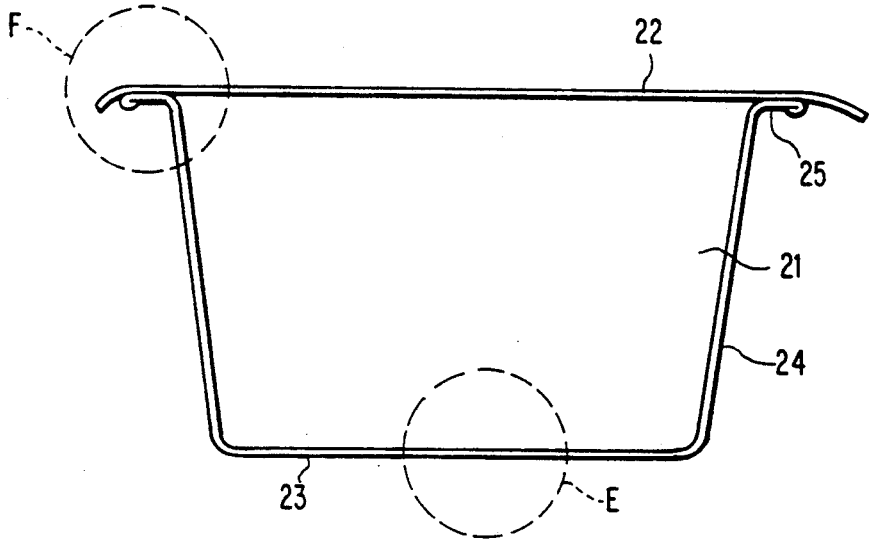
FIG. 6 is a section view along the line D—D of FIG. 1.

It is also allowable to use, as the tin layer 32, a tin-containing laminated material using a foil other than the tin foil. An example thereof is shown in FIGS. 9-1. FIGS. 9-1 and 9-2(*a*) and (*b*) are section views of the content-accommodating portion and of the heat-sealed portion of the container.

As shown, the laminated material consists of a tin layer 32 on the inner surface of the thermoplastic resin film 27, and a resin layer 29 adhered to the inner surface thereof. In the content-accommodating portion, the resin layer 29 consists of a porous resin layer 29-1 as shown in FIG. 9-1 and consists in the heat-sealed portion of a continuously covering resin layer 29-2 as shown in FIG. 9-2(*a*) or of a resin layer which is a continuously covering resin layer 29-2 as shown in FIG. 9-2(*b*) in which the pores may exist but on the inside having diameters narrower than the width of the heat-sealed portion as independent pores without communicated with each other.

The tin layer 32 consists of a tin foil or a thin tin film such as a film formed by the vapor deposition of tin or a nonelectrolytically plated tin film. The thin tin film is formed on one surface of the thermoplastic resin film by vapor deposition or nonelectrolytic plating. Further, the thermoplastic resin film 29 usually consists of a single film but often consists of a laminate of two films. This material can be used not only for the container body 21 but also for the closure 22.

Next, described below is an embodiment of a pouch which is another example of the container of the present invention.

Figure 10:
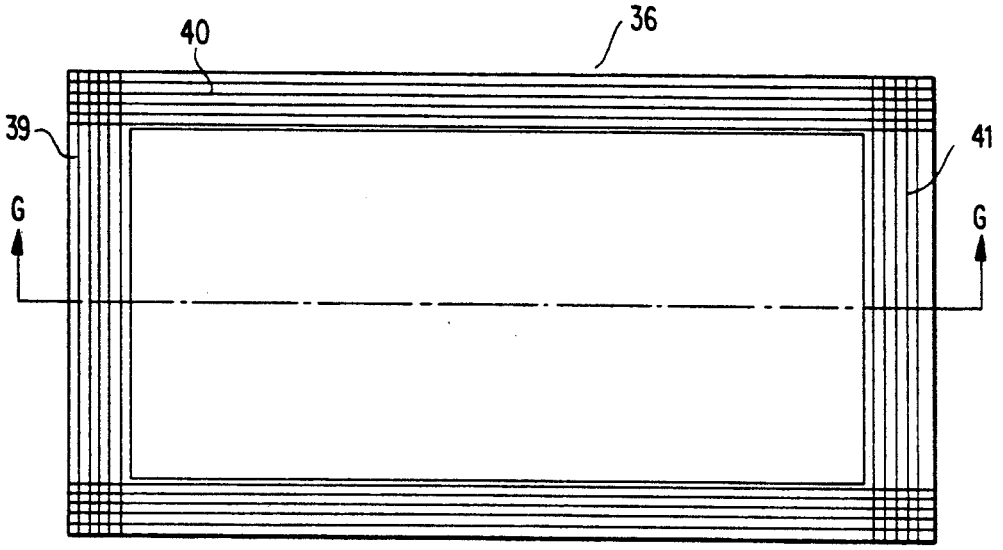
FIG. 10 is a plan view of a pouch which is a container according to the present invention.
Figure 11:
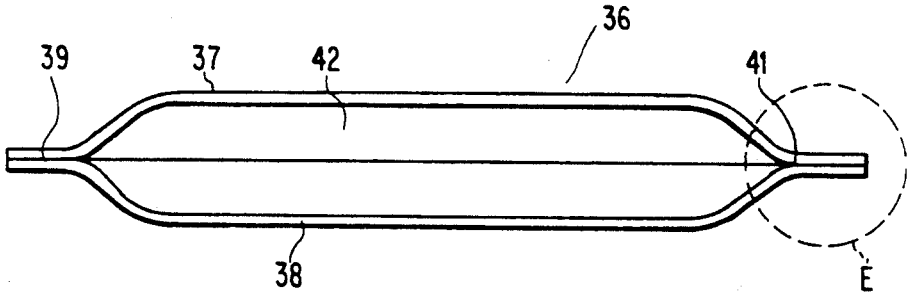
FIG. 11 is a section view along the line G—G of FIG. 10.
Figure 12:
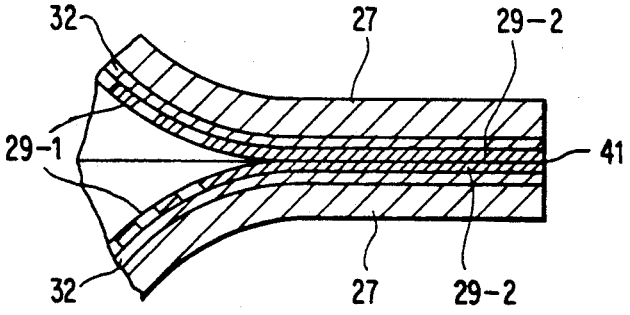
FIG. 12 is a diagram showing a portion H of FIG. 11 on an enlarged scale.

FIG. 10 is a plan view of the pouch, FIG. 11 is a section view along the line G—G of FIG. 10, and FIG. 12 is a view showing a portion H of FIG. 11 on an enlarged scale.

In the drawings, reference numeral 36 denotes a pouch, and 37 and 38 denote tin-containing laminated materials that are opposed to each other and are heat-sealed along the peripheral portions thereof, i.e., along heat-sealed portion 39 at the upper edge, heat-sealed portion 40 at both side edges, and heat-sealed portion 41 at the lower edge, thereby forming a container having a portion 42 for accommodating content as well as excellent sealability. The tin-containing laminated materials 37 and 38 may have the structure shown, for example, in FIG. 9-1. In the heat-sealed portion as shown in FIG. 12, the resin layers 29-1 on the inner surface sides of the tin-containing laminated materials are bonded together by heating to accomplish perfect sealability.

As described earlier, furthermore, the resin layer 29-2 in the heat-sealed portion consists of a continuously covering resin layer or a resin layer which is a continuously covering layer (continuously covering resin layer) in which the pores may exist but on the inside having diameters narrower than the width of the heat-sealed portion as independent pores which are not communicated with each other. Thus, the sealability is maintained based on the heat-sealing.

When the container of the present invention is to be formed by the draw-molding according to the first embodiment or the second embodiment, it is particularly desired that the tin is exposed only on the bottom portion inside the container and a primer coating is applied to the side walls, in order to protect the side walls, to prevent the container from blackened by the draw-molding, to prevent the molding punch from contaminated, and to control the amount of tin elution caused by the molding.

Described below are the materials used for the present invention.

A thermoplastic resin film is usually used for the tin-containing laminated material for constituting the container body of a cup-like container with heat-sealable closure, tin-containing laminated material for constituting the pouch, and is further used as the thermoplastic resin outer surface protecting layer therefor.

Examples of the thermoplastic resin film that can be used include olefin-type resins such as polypropylene, polyethylene, propylene-ethylene copolymer, propylene-ethylene-butene copolymer, ethylene-1-butene copolymer, ethylene-acrylate copolymer, polyolefin ionomer; polyester resins such as polyethylene terephthalate, polytetramethylene terephthalate, polyethylene terephthalate/iosphthalate, polyethylene/butylele terephthalate, and polyethylene naphthoate; and polyamide resins such as nylon 6, nylon 6,6, nylon 6/6, 6 copolymer, nylon 12, nylon 11, nylon 6, 6/6, 10 copolymer, and nylon 6/11 copolymer. They may be crystalline, partly crystaline or noncrystalline. Preferably, however, they should be crystalline or partly crystalline. The above resins may contain pigment, coloring agent, optical and thermal stabilizer, flame-retarding agent, lubricating agent, and the like. The resin films that are preferred from the standpoint of properties and economy include a polypropylene film and a polyester film. The thermoplastic resin film that is used has a thickness of 5 to 100 μm and, usually, 15 to 80 μm.

The tin plate used for the tin-containing laminated material of the container body has a tin layer (tin-plated layer) usually on both surfaces of the steel layer (steel plate) but often on one surface thereof only. When the tin layer is formed on one surface only, the tin plate is laminated on the steel layer side on the thermoplastic resin.

The tin plate has a thickness of 20 to 200 μm and, preferably, 35 to 150 μm. The steel layer is coated with the tin layer in an amount of 2.5 to 25 g/m$^2$.

When the tin layer other than the tin plate is to be used, there can be used a tin foil, a film formed by the deposition of tin, or a thin tin film formed by the nonelectrolytic plating of tin. The tin foil is 5 to 25 μm to thickness. The thin tin film has tin in an amount of 0.25 to 25 g/m$^2$. The thin tin film is usually formed on one surface of a thermoplastic resin film that serves as a substrate.

According to the second embodiment of the present invention, the resin used for the resin layer formed on the tin layer of tin-containing laminated material is selected depending upon a combination with the resin layer on the inner surface of the closure. Examples of the resin layer include an acid-modified olefin resin, a coating material containing acid-modified olefin resin, a coating material of the type of epoxy-phenol resin, a coating material of the type of epoxy-urea resin, and the like resins.

The acid-modified olefin resin is obtained by graft-copolymerizing an olefin resin such as polypropylene, propylene-ethylene copolymer or polyethylene with an ethylenically unsaturated carboxylic acid an anhydride thereof such as anhydrous maleic acid, acrylic acid, methacrylic acid, maleic acid, fumaric acid, anhydrous itaconic acid or citraconic acid, the concentration of carbonyl groups (—C—) based on carboxylic groups being 5 to 700 mmol per 100 g of the resin, and particularly 10 to 500 mmol per 100 g of the resin.

The above resin is used in the form of a film, stretched film or organosol.

The acid-modified olefin resin-containing coating material is obtained by dispersing a powder of acid-modified olefin resin in a thermosetting-type coating material such as an epoxy-phenol resin-type coating material, an epoxy-urea rein-type coating material, an epoxy-melamine resin-type coating material or a thermosetting vinyl resin-type coating material, or in a thermoplastic-type coating material such as a thermoplastic vinyl resin-type coating material or a polyester-type coating material.

It is further allowable to use the coating material components only without mixed with the acid-modified olefin resin. The coating materials that can be used are not necessarily limited to the above examples only but may be any compound if it adheres well to the tin layer.

The laminated material of the container body is usually obtained by press-adhering the heated steel foil through a heated laminate roll onto the thermoplastic resin film on which the adhesion primer (e.g., of the type of urethane resin) has been applied followed by drying, and then cooling the film; i.e., the resin film on which the tin plate is laminated is obtained. When the tin is to be exposed on the bottom surface only according to the second embodiment, a layer of the acid-modified olefin resin is formed on the surface of the tin plate on the side wall portions. When a high temperature is required for forming the film such as applying the thermosetting coating material, the coating material is first applied onto the tin plate and is heated and baked, and then the thermoplastic resin layer is formed.

FIG. 9-1 shows a tin-containing laminated material according to the second embodiment. In this case, the resin film on which the tin foil is laminated is obtained by laminating the tin foil on the thermoplastic olefin resin film in the same manner as when the resin film on which the tin plate is laminated is prepared. Or, a thin tin film is formed by depositing tin on one surface of the thermoplastic resin film, or the thin tin film is formed by the nonelectrolytic tin plating, or a thin layer 32 is formed on a thermoplastic resin film laminated on the resin film and, then, a resin layer 29 is formed thereon.

The porous resin layer according to the second embodiment is provided by the method described below.

The resin layer which is composed of the acid-modified olefin resin is perforated by, for example, discharge processing, punching or any other widely known method, or a stretched and perforated film is melt-adhered by heating onto the tin layer and an organosol is applied to the heat-sealable portions only followed by heating and drying to form the continuously covering layer. Or, a hot-melted resin is applied thereto. When the heat-sealable portion is rendered to be a continuously covering film, the film of the acid-modified olefin resin or the stretched film is perforated (or which may be a porous one, the same holds hereinafter) over the areas that serve as a portion for accommodating content but without perforating the heat-sealable portions. The film is then laminated on the tin layer.

The organosol is applied onto the tin layer and is heated and dried so that the resin particles are melt-adhered thereto to form a porous film. On the heat-sealable portion, the organosol is applied in large amounts or is applied repetitively, and is heated and dried to form a continuously covering layer, or a hot-melted resin is applied thereto.

The acid-modified olefin resin layer has a thickness of about 1 to 10 μm. Furthermore, the porous acid-modified olefin resin layer has a porous diameter of about 0.1 μm to about 2 mm which, however, may be smaller or greater than the above range. Though there is no particular limitation, the exposed area of tin of the tin-containing laminated material in the content-accommodation portion relative to the area of the tin-containing laminated material should be from 5 to 90% and desirably from 10 to 80%.

On the heat-sealable portion, furthermore, a primer for adhesion may be applied onto the underlying tin layer prior to forming the acid-modified olefin resin layer. The primer may consist of dispersing the acid-modified olefin resin particles in the coating material of the type of, for example, epoxy-phenol resin, epoxy-amino resin, epoxy-acrylic resin, epoxy-vinyl resin, epoxy resin or urethane resin. In this case, the acid-modified olefin resin should be used in an amount over a range of 2 to 50% by weight and, particularly, over a range of 10 to 20% by weight based on the solid component of the primer.

When the coating material in which the acid-modified olefin resin is dispersed or the coating material only is used as the resin layer, it should be applied in spots using a roll coater or in a suitable pattern using a gravure roll.

The container is produced as described below.

The container body is prepared by punching the sheet of a laminated material into a required shape and size such that the tin plate becomes the inside of the container, forming the punched sheet into a seamless container with flange, and curling the peripheral edge of the flange in a manner that the curled portion is lower than the sealed surface.

The gas-barrier substrate used as a material of the closure is composed of a metal foil such as aluminum foil, tin plate, or stainless tin plate, or a resin film having excellent gas-barrier property such as a saponified product (EVA saponified product) of an ethylene-vinyl acetate copolymer, a polyvinylidene chloride copolymer (PVDC), m-xylene adipamide (MXD 6 nylon), SELARPA (trade name of Du Pont Co., noncrystalline nylon which is a copolymer of terephthalic acid, isophthalic acid and hexamethylene diamine), polyacrylonitrile (PAN), liquid crystalline polyester, or Aramid (wholly aromatic nylon). When it is required to obtain a transparent closure, there is used a resin film. The gas-barrier substrate has a thickness that varies depending upon the material and the object of use, and is usually 5 to 50 μm thick.

A heat-sealable thermoplastic resin is used as the protective resin layer on the inner surface side of the gas-barrier substrate. In the case of the container of the second embodiment, the resin layer on the inner surface side is selected depending upon the resin layer on the tin layer of the container body. When the resin layer is an acid-modified olefin resin layer or a coating material in which the acid-modified olefin resin is dispersed, there is used the same one as the of the aforementioned thermoplastic resin, the same one as that of the acid-modified olefin resin, or a combination thereof. When the resin layer consists of the aforementioned coated film, there is used the acid-modified olefin resin or a polyester-type resin. The protective resin layer on the outer surface side of the gas-barrier substrate may be composed of the above protective resin layer or may be composed of a coated film formed by applying a coating material or a printing paint. The coated film can be obtained by using a thermosetting resin coating material such as phenol-formaldehyde resin, furan-formaldehyde resin, xylene-formaldehyde resin, ketone-formaldehyde resin, urea-formaldehyde resin, melamine-formaldehyde resin, alkyd resin, unsaturated polyester resin, epoxy resin. bismaleimide resin, triarylcyanurate resin, thermosetting acrylic resin, silicone resin, oil resin, or a thermoplastic resin coating material such as vinyl chloride-vinyl acetate copolymer, partly saponified product of vinyl chloride-vinyl acetate copolymer, vinyl chloride-maleic acid copolymer, vinyl chloride-maleic acid-vinyl acetate copolymer, acrylic polymer, or saturated polyester resin. These resin coating materials may be used in a single kind or in a combination of two or more kinds.

In the case of the container according to the second embodiment, the resin layer may not be provided depending upon the kind of the gas-barrier substrate.

When the gas-barrier substrate consists of a resin film, the protective resin layer and the coating are laminated thereon. In this case, a primer for adhesion is used as required. When the coating material is used, it is heated and dried after the application.

The closure is formed by punching the laminated material consisting of the gas-barrier substrate and protective resin layers covering the inner and outer surfaces thereof into a predetermined shape and size.

It is further allowable to use a metal foil (e.g., aluminum foil) as the gas-barrier substrate of the closure, and effecting the scoring and attaching an opening tab to obtain a so-called easy-to-open closure.

In the first embodiment, the acid-modified olefin resin layer provided on the upper surface of the flange portion of the seamless container with flange may be composed of a mixture with an olefin resin graft-modified with an acid or an acid anhydride, or may be a layer of an organic coating material obtained by dispersing the modified olefin resin. The acid-modified olefin resin may be the ones mentioned earlier.

The acid-modified olefin resin covers the upper surface of flange portion of the container body, i.e., covers the surface of the tin layer of flange portion. Usually, the organosol (dispersed in an organic solvent) is applied, and is heated and dried to cover the surface. Moreover, a resin film is melt-adhered by heating to cover the surface or a hot-melted resin is applied to cover the surface.

The acid-modified olefin resin layer is about 1 to 20 μm in thickness. Prior to providing the acid-modified olefin resin layer, furthermore, there may be applied a primer for adhesion that is obtained by dispersing the acid-modified olefin resin in the epoxy-phenol resin-type coating material, epoxy-amino resin-type coating material, epoxy-acrylic resin-type coating material, or epoxy-vinyl resin-type coating material. In this case, the acid-modified olefin resin is used in an amount of 2 to 50% by weight and, particularly, in an amount of 5 to 20% by weight based on the solid content of the primer.

To heat-seal the closure to the container body, the closure is placed on the container body after the content has been introduced therein, and the protective resin layer on the inner surface of the closure and the resin layer on the surface of flange portion of the container body are melt-adhered together by heating using a heat-sealing device (e.g., high-frequency induced heating system) thereby to form the heat-sealed portion and to form a cup-like container with heat-sealed closure containing content and maintaining excellent sealability.

The pouch is obtained by, for example, superposing two tin-containing laminated materials having the acid-modified olefin resin film with a continuously covering layer portion (corresponds to the heat-sealable portion) and a porous portion (corresponds to the portion for containing content) laminated on the tin layer in a manner that the acid-modified olefin resin film is on the inside and that the heat-sealable portions of the two laminated members are brought in contact with each other. Then, the lower edge and two side edge excluding the upper edge of the pouch are heat-sealed followed by cutting thereby to obtain the pouch with its heat-sealable portion at the upper edge open. The heat-sealable portion may be heat-sealed flat. In order to obtain reliable sealing by the heated press-adhesion using the heat-sealing device, however, the heat-sealable portion is usually heat-sealed with pressure in a wave form using a metal mold.

After the content is charged into the content-accommodating portion through the opening at the upper edge of the pouch, the heat-sealable portion at the upper edge is press-adhered with heating to melt and bond together the acid-modified olefin resin layers in order to form the pouch containing the content maintaining excellent sealability. It is further allowable that only one of the opposing laminated materials has the acid-modified olefin resin but the other one has an ordinary olefin resin.

EXAMPLES

Example 1

An urethane resin-type primer was applied as a primer layer for adhesion on one surface of a crystalline polypropylene film (containing titanium white, 75 μm thick) and was dried, and was then press-adhered onto a heated tin plate (100 μm thick) through a laminate roll to obtain a resin film-laminated tin plate from which a seamless container with flange was obtained.

A layer of a polypropylene-ethylene copolymer (average carbonyl group concentration of 40 meq/100 g of polymer, MP 170° C., MI 50) modified with anhydrous maleic acid was provided using an organosol on the upper surface of the flange portion and was heated and dried.

The closure was prepared by punching a laminated material into a predetermined shape, the laminated material being obtained by laminating a polypropylene film (40 μm thick) on an aluminium foil (30 μm thick) via the urethane resin-type adhesion primer layer and applying an epoxy-urea resin-type coating material (coated film having a thickness of 6 μm) on the outer surface side followed by baking.

Content such as food was introduced into the container body, the closure was placed thereon and was heat-sealed by the high-frequency induced heating, in order to obtain the container of the present invention containing the content. The container exhibits excellent sealability as well as ability for preventing the content from oxidizing, and is easily openable. The grip portion at the tip of the closure is held to easily pull open the closure away from the container body.

In order to examine the container for its oxidation-preventing ability, flavor retentivity and corrosion for the content, the container bodies were nearly fully filled with oranges (A), peaches (B)° mushrooms (C), bamboo shoots (D) and lotus roots (E) each in the number of thirty, and the closures were placed thereon and were sealed by the high-frequency induced heating.

The sealed containers A to C were sterilized by heating at 95° C. for 40 minutes and the sealed containers D and E were sterilized by heating at 120° C. for 30 minutes. The containers developed no abnormal appearance. After preserved at 37° C. for one month, the containers were opened to examine a change in color of the content, a change in pH value, a change in flavor and viscosity as well as pitting or leakage of the container, blister and corroded condition of the tin plate. The results were all favorable and the contents of foods were not degenerated. Further, the containers were free from pitting, leakage, or blister, and the tin plate was in good condition. The results were as shown in Table 1.

Comparative Example 1

The container body and the closure were formed in the same manner and in the same shape as that of Example 1 and the same acid-modified olefin resin layer was used, with the exception of using a laminated material obtained by laminating a nylon film (40 μm thick) on the outer surface side of the aluminum foil (80 μm thick) via the urethane resin primer layer and laminating a polypropylene film (70 μm thick) on the inner surface side thereof via the urethane resin primer layer.

Mushrooms were contained in the container in the same manner as in Example 1, and the closure was placed thereon and was heat-sealed. The container was heat-sterilized in the same manner as in Example 1 but did not develop any abnormal appearance. After preserved at 37° C. for one month in the same manner as in Example 1, the container was opened to examine the content. There were changes in the color and flavor of the content, and the quality was degenerated compared with that of Example 1, though there was recognized no pitting, blister or corrosion of the container.

TABLE 1

| Contents | Sterilizing condition (temp., time) | Preservation priod | Change in color | Change in pH | Change in flavor | Viscosity | Usable | Pitting and leakage | Blister | Corrosion of tin plate |
|---|---|---|---|---|---|---|---|---|---|---|
| A | 95° C., 40 min | 37° C., one month | none | none | good | no change | yes | none | none | none |
| B | " | " | none | none | good | no change | yes | none | none | none |
| C | " | " | none | none | good | no change | yes | none | none | none |
| D | 120° C., 30 min | " | none | none | good | no change | yes | none | none | none |
| E | " | " | none | none | good | no change | yes | none | none | none |

Example 2

Onto the tin plate (75 μm thick) was applied a primer obtained by dispersing a polypropylene/ethylene copolymer (average carboxyl group concentration of 40 meq/100 g of the polymer, MP 170° C., MI 50) modified with anhydrous maleic acid in an amount of 10 phr in the epoxy phenol-type coating material in the shape of a doughnut having an outer diameter of 130 mm and an inner diameter of 50 mm followed by heating and baking. Then, a polypropylene film (40 μm thick) containing titanium white was laminated via the urethane resin-type primer on the tin plate on the back surface side of the primer, followed by aging at 50° C. to prepare a resin film-laminated tin plate having a doughnut-shaped primer layer on one surface thereof. Using this material, seamless cup-like containers with flange were continuously obtained having the resin film on the outer surface side and a central doughnut-shaped portion where no primer was applied on the inner bottom surface portion using a press-molding machine (container a).

Furthermore, similar containers were continuously produced from the material on which the inner surface has been applied the primer layer in the shape of a doughnut maintaining an outer diameter of 130 mm and an inner diameter of 100 mm (container b).

These containers a and b that were being produced and the molding punch were examined for their contamination. The results were as shown in Table 2.

Then, mushrooms and a seasoning liquid consisting of table salt, citric acid, and ascorbic acid were contained in the containers and a closure composed of polypropylene, adhesive agent, aluminum foil, adhesive agent and polypropylene was heat-sealed thereon. The containers containing mushrooms were sterilized by heating at 115° C. for 45 minutes, and were then preserved at 35° C. to measure the preserved condition of the content and the amount of tin eluted into the content every after a predetermined period of time. The results were as shown in Table 2.

As will be obvious from Table 2, the molding punch and the containers were not contaminated in the case of the containers a that were coated with the primer layer up to the side walls thereof. In the case of the containers b having the primer layer covering the flange portion only, on the other hand, the contamination developed immediately after the start of molding.

The contents were preserved well by both the containers a and containers b, but the containers a permitted tin to the eluted in smaller amounts into the content presenting advantage from the sanitary point of view.

TABLE 2

| | Preserv-ability | Contamin-ation* | Amount of tin eluted (ppm) one day | one week | one month | three months |
|---|---|---|---|---|---|---|
| Con-tainer a | ° | >1000 | 18 | 23 | 50 | 52 |
| Con-tainer b | ° | 10 | 70 | 87 | 97 | 111 |

*Number of containers produced before contamination occurred.

Example 3

An urethane resin-type primer was applied as a primer layer for adhesion on one surface of a crystalline polypropylene film (containing titanium white, 40 μm thick) and was dried, and was then press-adhered onto a heated tin plate (75 μm thick) through a laminate roll to obtain a resin film-laminated tin plate. Moreover, an organosol composed of a polypropylene/ethylene copolymer (average carboxyl group concentration of 40 meq/100 g of the polymer, MP 170° C., MI 50) modified with anhydrous maleic acid was applied onto the tin plate, and was heated and dried to form a porous acid-modified olefin resin layer in order to obtain a tin-containing laminated material from which a seamless cup-like container with flange was obtained. The organosol was applied onto the upper surface of the flange portion followed by heating and drying to obtain a continuously covering layer composed of the acid-modified olefin resin.

The closure was prepared by punching a laminated material into a predetermined shape, the laminated material being obtained by treating the surfaces of an aluminum foil (30 μm thick) with chromate, laminating a polypropylene film (40 μm thick) on the inner surface of the aluminum foil via the urethane resin-type adhesion primer layer and applying an epoxy-urea resin-type coating material (coated film having a thickness of 6 μm) on the outer surface side followed by baking.

Content such as food was introduced into the container body, the closure was placed thereon and was heat-sealed by the high-frequency induced heating, in order to obtain the cup-like container with closure of the present invention containing the content. The container exhibited excellent sealability as well as ability for preventing the content from oxidizing, and was easily openable. The grip portion at the tip of the closure was held to easily pull open the closure away from the container body.

In order to examine the container for its oxidation-preventing ability, flavor retentivity and corrosion for the content, the container bodies were nearly fully filled with oranges (A'), peaches (B'), mushrooms (C'), bamboo shoots (D') and lotus roots (E') each in the number of thirty, and the closures were placed therein and were sealed by the high-frequency induced heating.

The sealed containers A' to C' were sterilized by heating at 95° C. for 40 minutes and the sealed containers D' and E' were sterilized by heating at 120° C. for 30 minutes. The containers developed no abnormal appearance. After preserved at 37° C. for one month, the containers were opened to examine a change in color of the content, a change in pH value, a change in flavor and viscosity, as well as pitting or leakage of the container, blister and corroded condition of the tin plate. The results were all favorable and the contents of foods were not degenerated. Further, the containers were free from pitting, leakage, or blister, and the tin plate was in good condition. The results were as shown in Table 3.

Comparative Example 2

The container body and the closure were formed in the same manner as that of Example 3 with the exception of using a laminated material obtained by treating the aluminum foil (80 μm thick) with chromate, laminating a nylon film (40 μm thick) on the outer surface side thereof via the urethane resin primer layer and laminating a polypropylene film (70 μm thick) on the inner surface side thereof via the urethane resin primer layer. The organosol of the acid-modified olefin resin used in Example 3 was applied onto the upper surface of flange portion of the container body, followed by heating and drying to obtain a continuously covering layer composed of the acid-modified olefin resin.

Mushrooms were contained in the container in the same manner as in Example 3, and the closure was placed thereon and was heat-sealed. The container was heat-sterilized in the same manner as in Example 3 but did not develop any abnormal appearance. After preserved at 37° C. for one month in the same manner as in Example 3, the container was opened to examine the content. There were changes in the color and flavor of the content, and the quality was degenerated compared with that of Example 3, though there was recognized no pitting, blister or corrosion of the container.

TABLE 3

| Contents | Sterilizing condition (temp., time) | Preservation priod | Change in color | Change in pH | Change in flavor | Viscosity | Usable | Pitting and leakage | Blister | Corrosion of tin plate |
|---|---|---|---|---|---|---|---|---|---|---|
| A' | 95° C., 40 min | 37° C., one month | none | none | good | no change | yes | none | none | none |
| B' | " | " | none | none | good | no change | yes | none | none | none |
| C' | " | " | none | none | good | no change | yes | none | none | none |
| D' | 120° C., 30 min | " | none | none | good | no change | yes | none | none | none |
| E' | " | " | none | none | good | no change | yes | none | none | none |

Example 4

A urethane resin-type primer was applied as a primer layer for adhesion on one surface of a crystalline polypropylene film (containing titanium white, 40 μm thick) and was dried, and was then press-adhered onto a heated tin plate (75 μm thick) through a laminate roll to obtain a resin film-laminated tin plate. Moreover, a drawn and perforated film (20 μm in thickness, 2 mm in porous diameter, and 100 pores per 25 $cm^2$) of a polypropylene polymer (Modic P-310K, a product of Mitsubishi Yuka Co.) modified with anhydrous maleic acid was press-adhered with the application of heat onto the tin plate to obtain a tin-containing laminated material from which a seamless cup-like container with flange was obtained. The organosol composed of the acid-modified olefin resin of Example 3 was applied onto the upper surface of the flange portion followed by heating and drying to obtain a continuously covering layer composed of the acid-modified olefin resin.

The closure was formed in the same manner as in Example 3.

After the content was introduced into the container body, the closure was placed thereon and was sealed by the high-frequency induced heating to obtain the cup-like container with closure of the present invention containing the content.

Example 5

An epoxy-phenol resin-type primer was applied as a primer layer for adhesion onto one surface of a biaxially oriented polyester film (50 μm thick) and dried, and on which a tin foil (25 μm thick) was laminated. Then, a drawn film composed of a polypropylene-ethylene copolymer modified with anhydrous maleic acid was perforated (2 mm in porous diameter, 100 pores per 25 $cm^2$) by punching over the portion corresponding to the content-accommodating portion, and was press-adhered with the application of heat onto the tin foil to obtain a tin-containing laminated material. This material was cut into a rectangular shape maintaining a predetermined size in a manner that the periphery corresponding to the heat-sealable portion became the continuously covering layer of acid-modified olefin resin and the portion corresponding to the content-accommodating portion became the layer of porous polyolefin resin. Thus the cut two pieces of the tin-containing laminated material was superposed in a manner that the acid-modified olefin resin layers were faced inwards and the heat-sealable portions came in contact with each other. Then, the heat-sealable portions of the lower edge and both side edge, except the upper edge, were press-adhered together using a heat-sealing device to melt-adhere the acid-modified olefin resin layers of the heat-sealable portions in order to form a pouch.

After the content was introduced into the pouch through the opening at the upper edge of the pouch, the heat-sealable portion at the upper edge was press-adhered by the application of heat using the heat-sealing device in order to obtain the pouch which is a container of the present invention containing the content.

The pouch exhibited excellent content preservability and heat-sealability.

Example 6

An acid-modified olefin resin (Liothene M1063-4, a product of Toyo Ink Co.) was laminated on a biaxially oriented polypropylene film (30 μm thick) by the extrusion-coating method. This film was perforated using a punching roll to form pores 2 mm in diameter at a rate of 100 pores per 25 $cm^2$. The acid-modified olefin resin layer of the above laminated film was press-adhered with the application of heat onto a tin plate (75 μm thick) to obtain a tin-containing laminated material. Then, a urethane resin-type primer was applied as a primer layer for adhesion onto the non-laminated side of the tin plate followed by drying, and a polypropylene film (containing titanium white, 40 μm thick) was laminated thereon to obtain a container material from which a seamless cup-like container with flange was formed. After the boiled mushrooms were introduced into the container body, the closure was placed thereon and was heat-sealed. The closure was comprised of a PET (12 μm), an aluminum foil (9 μm) and a PP (30 μm). After retorted at 120° C. for 30 minutes, the container was preserved at 37° C. Even after one month has passed, the content was not degenerated but was in good quality.

Example 7

The tin foil (75 μm thick) was pattern-coated with an epoxy-urea resin-type coating material (epoxy resin: urea rein=85:15, 25% by weight of solid component). In forming the container, the coating material was applied all over on the flange portion but was not applied on the wall or the bottom on the inner surface of the container to form a doughnut-like pattern. After heated and dried at 200° C. for 10 minutes, a polypropylene film (containing titanium white, 75 μm thick) was laminated thereon. Using this tin plate-laminated material, a seamless cup-like container with flange was prepared in a manner that the titanium-containing polypropylene film was on the outer surface side and the coated surface was on the flange portion. The closure consisted of a PET (12 μm), an aluminum foil (9 μm) and an acid-modified PP (10 μm). After the mushrooms were introduced as the content, the container body and the acid-modified PP surface of the closure were heat-sealed together, followed by retorting at 120° C. for 30 minutes. The container was then preserved at 37° C. Even after one month has passed, the content was not degenerated but was in good quality. No abnormality was found with the container, either.

Example 8

The same testing was carried out by using an epoxy-phenol resin-type coating material in which was dispersed an acid-modified PP (Unistole R-100, a product of Mitsui Petrochemical Industrial Co. Ltd.,) in an amount of 10% by weight instead of using the epoxy-urea resin-type coating material of Example 5. The closure member consisted of a PET (12 μm), an aluminum foil (9 μm) and a PP (30 μm). After the content was introduced, the acid-modified PP-dispersed epoxy-phenol resin type coating material on the flange portion and the PP side of the closure were heat-sealed together. After retorted at 120° C. for 30 minutes, the container was preserved at 37° C. Even after preserved for one month, the content maintained good quality. No abnormality was found with the container.

Example 9

An epoxy-phenol resin-type coating material (epoxy resin: phenol resin=85:15, 28% by weight of solid component) was pattern-printed on the tin plate with 25 pores (2 mm in diameter) per 25 $cm^2$. The testing was carried out in the same manner as in Example 8. After retorted, the container was preserved at 37° C. Even after one month has passed, the content was preserved in good quality. No abnormality was found with the container.

We claim:

1. A container having excellent ability for preventing discoloring or degenerating contents of the container, comprising:

a seamless container that comprises a tin plate; a thermoplastic resin film formed on one surface of the tin plate; a resin coating layer in the shape of a doughnut formed on the other surface of the tin plate; a bottom; a side wall; and a flange;

wherein the container is draw-formed so that the resin film is on the outer surface of the container and the resin coating layer is on the inner surface of the container, and the inner surface of the tin plate in the side wall and the flange is covered with the resin coating layer, but the inner surface of the tin plate in the bottom is exposed to the inside of the container;

a flexible closure comprising a laminated material of a gas-barrier substrate; a protecting resin layer covering the outer surface of the substrate and an acid-modified olefin resin layer covering the inner surface of the substrate; and a sealed portion formed by heat-sealing the acid-modified olefin resin layer of the closure with the resin coating layer of the flange.

2. A container having excellent preservability for contents of the container and heat-sealability comprising opposing laminated materials, wherein the peripheries of the opposing laminated materials are heat-sealed together and a portion for containing the content of the container is formed between said opposing laminated materials, wherein at least one of sad opposing laminated materials is a tin-containing laminated material consisting of (1) a thermoplastic resin outer surface protecting layer, (2) a metallic layer, selected from the group consisting of a metal foil and a thin film of tin, on the inner surface of the container, and (3) a resin layer formed on the inner surface of said metallic layer, wherein said tin-containing laminated material has a resin layer that is porous and that permits tin to be partly exposed to the inside of the container.

3. A container according to claim 2, wherein the tin-containing laminated material is a tin plate.

4. A container according to claim 1, wherein the tin-containing laminated material layer is exposed to the inside of the container only on the bottom surface of the container.

5. A container having excellent ability for preventing discoloring or degenerating contents of the container, comprising:

a seamless container that comprises a tin plate; a thermoplastic resin film formed on one surface of the tin plate; a resin coating layer containing an acid-modified olefin resin in the shape of a doughnut formed on the other surface of the tin plate; a bottom; a side wall; and a flange;

wherein the container is draw-formed so that the resin film is on the outer surface of the container and the resin coating layer is on the inner surface of the container, and wherein the inner surface of the tin plate in the side wall and the flange is covered with the resin coating layer, but the inner surface of the tin plate in the bottom is exposed to the inside of the container;

a flexible closure comprising a laminated material made of a gas-barrier substrate, a protecting resin layer covering the outer surface of the substrate and an olefin resin layer covering the inner surface of the substrate; and a sealed portion formed by heat-sealing the olefin resin layer of the closure with the resin coating layer of the flange.

6. A container according to claim 5, wherein said resin coating layer comprises an epoxy-phenolic resin and an acid-modified olefin resin dispersed therein.

7. A container according to claim 5, wherein said resin coating layer comprises an epoxy-phenolic resin and an acid-modified propylene-ethylene copolymer dispersed therein and the olefin resin layer of the closure comprises a polypropylene film.

8. A container according to claim 5, wherein the tin plate has a thickness of 20 to 200 μm and has a coated tin amount of 2.5 to 25 g/m$^2$.

9. A container having excellent preservability for contents of the container, comprising:

a seamless container that comprises a tin plate; a thermoplastic resin film formed on one surface of the tin plate; a resin coating layer containing an acid-modified olefin resin formed on the other surface of the tin plate; a bottom; a side wall; and a flange, wherein the container is draw-formed so that the resin film is on the outer surface of the container and the resin coating layer is on the inner surface of the container, and the resin coating layer in the flange is a continuously covering layer, but the resin coating layer in portions other than the flange is a porous layer;

a flexible closure comprising a laminated material of a gas-barrier substrate; a protecting resin layer covering the outer surface of the substrate and an olefin resin layer covering the inner surface of the substrate; and a sealed portion formed by heat-sealing of the olefin resin layer of the closure with the resin coating layer of the flange.

10. A container according to claim 9, wherein said porous layer is formed by coating an organosol of the acid-modified olefin resin, and said continuously covering layer is formed by coating and then heating the organosol of the acid-modified olefin resin on the porous layer.

11. A container according to claim 9, wherein said porous layer is a perforated olefin resin film laminated on the tin plate and said continuously covering layer is formed by coating and then heating an organosol of the acid-modified olefin resin on the perforated film.

12. A container according to claim 9, wherein said resin coating layer is a perforated laminate film of an olefin film and an acid-modified olefin resin layer coated thereon and said laminate film is laminated on the tin plate so that the acid-modified olefin contacts the tin plate.

* * * * *